US010267158B2

(12) United States Patent
Potter et al.

(10) Patent No.: US 10,267,158 B2
(45) Date of Patent: Apr. 23, 2019

(54) AIRFOIL FILLET

(71) Applicant: United Technologies Corporation, Hartford, CT (US)

(72) Inventors: Christopher Potter, Middletown, CT (US); Michael Espinoza, Middletown, CT (US); Joseph Steele, Middletown, CT (US)

(73) Assignee: UNITED TECHNOLOGIES CORPORATION, Farmington, CT (US)

( * ) Notice: Subject to any disclaimer, the term of this patent is extended or adjusted under 35 U.S.C. 154(b) by 955 days.

(21) Appl. No.: 14/862,361

(22) Filed: Sep. 23, 2015

(65) Prior Publication Data

US 2016/0177756 A1 Jun. 23, 2016

Related U.S. Application Data

(60) Provisional application No. 62/095,469, filed on Dec. 22, 2014.

(51) Int. Cl.
*F01D 5/14* (2006.01)
*F01D 5/34* (2006.01)

(52) U.S. Cl.
CPC ..... *F01D 5/143* (2013.01); *F01D 5/34* (2013.01); *F05D 2250/232* (2013.01)

(58) Field of Classification Search
CPC ..... F01D 5/141; F01D 5/143; F01D 5/145
See application file for complete search history.

(56) References Cited

U.S. PATENT DOCUMENTS 6,969,232 B2 * 11/2005 Zess ..... F01D 5/145 415/191
8,206,095 B2 * 6/2012 Parker ..... F01D 5/14 415/191
9,322,282 B2 * 4/2016 Chouhan ..... F01D 5/143
9,631,504 B2 * 4/2017 Bentley ..... F01D 9/02
2005/0106025 A1 * 5/2005 Snook ..... F01D 5/141 416/189

* cited by examiner

*Primary Examiner* — Woody A Lee, Jr.
(74) *Attorney, Agent, or Firm* — Snell & Wilmer, L.L.P.

(57) ABSTRACT

The present disclosure includes airfoils for use in gas turbine engines. The airfoils comprise a fillet having a height of greater than 20% of the airfoil body span length. The airfoil may be a blade or a vane. Further, such airfoils may be used in the high pressure compressor section, as well as other gas turbine engine sections.

20 Claims, 4 Drawing Sheets

AIRFOIL FILLET

CROSS-REFERENCE TO RELATED APPLICATIONS

This application is a nonprovisional of, and claims priority to, and the benefit of U.S. Provisional Application No. 62/095,469, entitled "AIRFOIL FILLET," filed on Dec. 22, 2014, which is hereby incorporated by reference in its entirety.

FIELD

The present disclosure relates generally to components of gas turbine engines and, more specifically, to airfoils used in sections of gas turbine engines.

BACKGROUND

Gas turbine engines typically include a compressor section, a combustor section and a turbine section. In general, during operation, air is pressurized in the compressor section and is mixed with fuel and burned in the combustor section to generate hot combustion gases. The hot combustion gases flow through the turbine section, which extracts energy from the hot combustion gases to power the compressor section and other gas turbine engine loads.

Airfoils, such as blades and vanes, are utilized in various engine sections to direct and extract energy from airflow entering the engine. Such airfoils may be subject to adverse conditions, including high temperatures, humidity, and mechanical stresses and strains. Airfoils having improved properties, such as increased strength, improved cyclic life, and/or improved vibration damping, may be desirable.

SUMMARY

An airfoil in accordance with various embodiments may comprise an airfoil body having a first end coupled to a platform and a second end radially extending from the platform and a fillet joining the first end of the airfoil body to the platform, and comprising a conic surface and a fillet height of at least about 20% of an airfoil body span length. The fillet height may be approximately 21% of the airfoil body span length. The airfoil may be positioned within a compressor section of a gas turbine engine. Further, the airfoil may be a high pressure compressor airfoil. The airfoil may be a blade. The airfoil may be a vane, and the second end of the airfoil body may be coupled to a second platform. The airfoil may include a second fillet having a second fillet height of at least about 20% of the airfoil body span length. The airfoil may be made from nickel.

A gas turbine engine in accordance with various embodiments may comprise an engine section comprising at least one of a turbine section and a compressor section and an airfoil positioned within the engine section comprising an airfoil body having a first end coupled to a platform and a second end radially extending from the platform and a fillet joining the first end of the airfoil body to the platform and having a fillet height of at least about 20% of an airfoil body span length. The fillet height may be approximately 21% of the airfoil body span length. The airfoil may be positioned within a compressor section of a gas turbine engine. Further, the airfoil may be a high pressure compressor airfoil. The airfoil may be a blade. The airfoil may be a vane, and the second end of the airfoil body may be coupled to a second platform, and the airfoil may include a second fillet having a second fillet height of at least about 20% of the airfoil body span length. The airfoil may be made from nickel.

BRIEF DESCRIPTION OF THE DRAWINGS

The subject matter of the present disclosure is particularly pointed out and distinctly claimed in the concluding portion of the specification. A more complete understanding of the present disclosure, however, may best be obtained by referring to the detailed description and claims when considered in connection with the drawing figures, wherein like numerals denote like elements.

DETAILED DESCRIPTION

The detailed description of embodiments herein makes reference to the accompanying drawings, which show embodiments by way of illustration. While these embodiments are described in sufficient detail to enable those skilled in the art to practice the inventions, it should be understood that other embodiments may be realized and that logical and mechanical changes may be made without departing from the spirit and scope of the disclosure. Thus, the detailed description herein is presented for purposes of illustration only and not for limitation. For example, any reference to singular includes plural embodiments, and any reference to more than one component or step may include a singular embodiment or step. Also, any reference to attached, fixed, connected or the like may include permanent, removable, temporary, partial, full and/or any other possible attachment option.

Among other features, this disclosure relates to airfoils of gas turbine engines that include improved fillets. The exemplary structures described herein may provide increased strength, improved cyclic life, and/or improved vibration damping, among other potential benefits.

Figure 1:
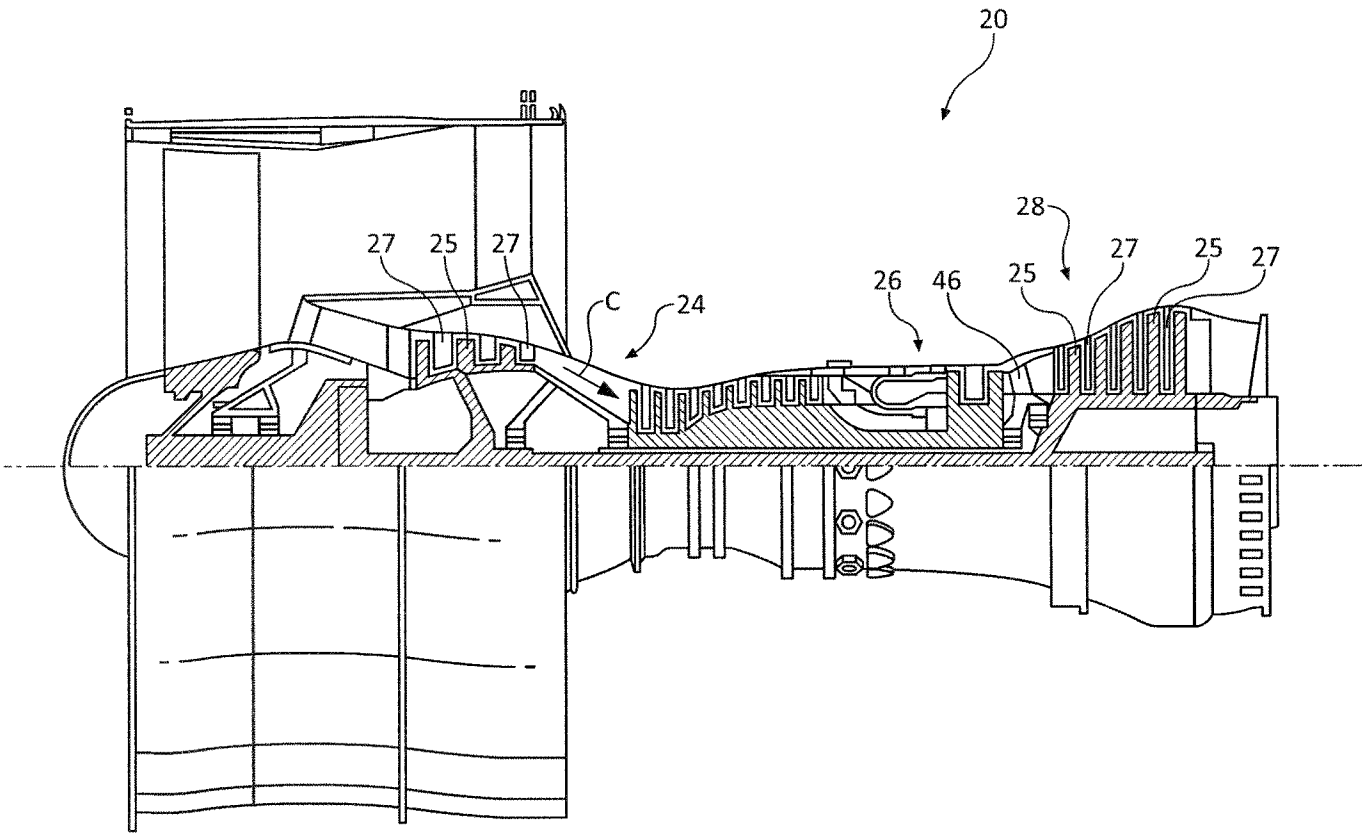
FIG. 1 illustrates, in accordance with various embodiments, a side view of a gas turbine engine.

Accordingly, with reference to FIG. 1, a gas turbine engine 20 is shown. In general terms, gas turbine engine 20 may comprise a compressor section 24. Air may flow through compressor section 24 and into a combustion section 26, where it is mixed with a fuel source and ignited to produce hot combustion gasses. These hot combustion gasses may drive a series of turbine blades within a turbine section 28, which in turn drive, for example, one or more compressor section blades mechanically coupled thereto.

Each of the compressor section 24 and the turbine section 28 may include alternating rows of rotor assemblies and vane assemblies (shown schematically) that carry airfoils that extend into the core flow path C. For example, the rotor assemblies may carry a plurality of rotating blades 25, while each vane assembly may carry a plurality of vanes 27 that extend into the core flow path C. Blades 25 create or extract energy (in the form of pressure) from the core airflow that is communicated through gas turbine engine 20 along the core flow path C. Vanes 27 direct the core airflow to blades 25 to either add or extract energy.

Figure 2A:
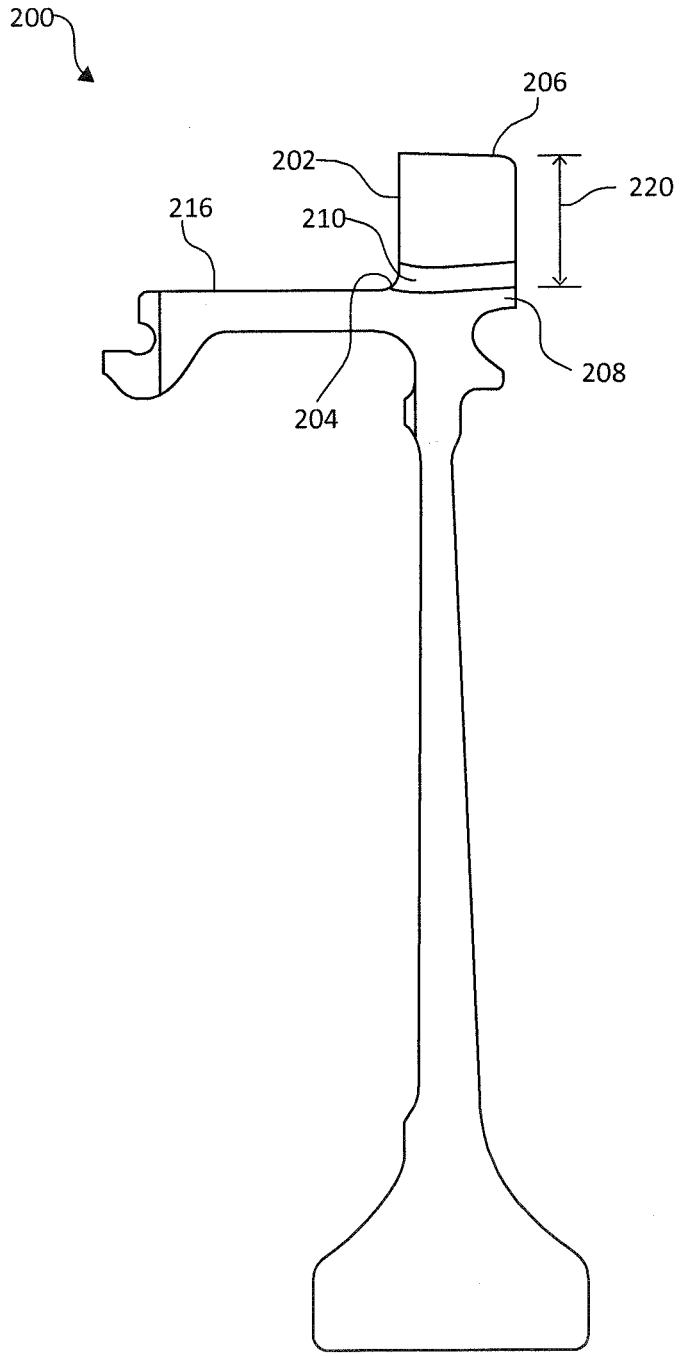
FIGS. 2A-2C illustrate, in accordance with various embodiments, side and perspective views of various airfoils of a gas turbine engine.
Figure 2B:
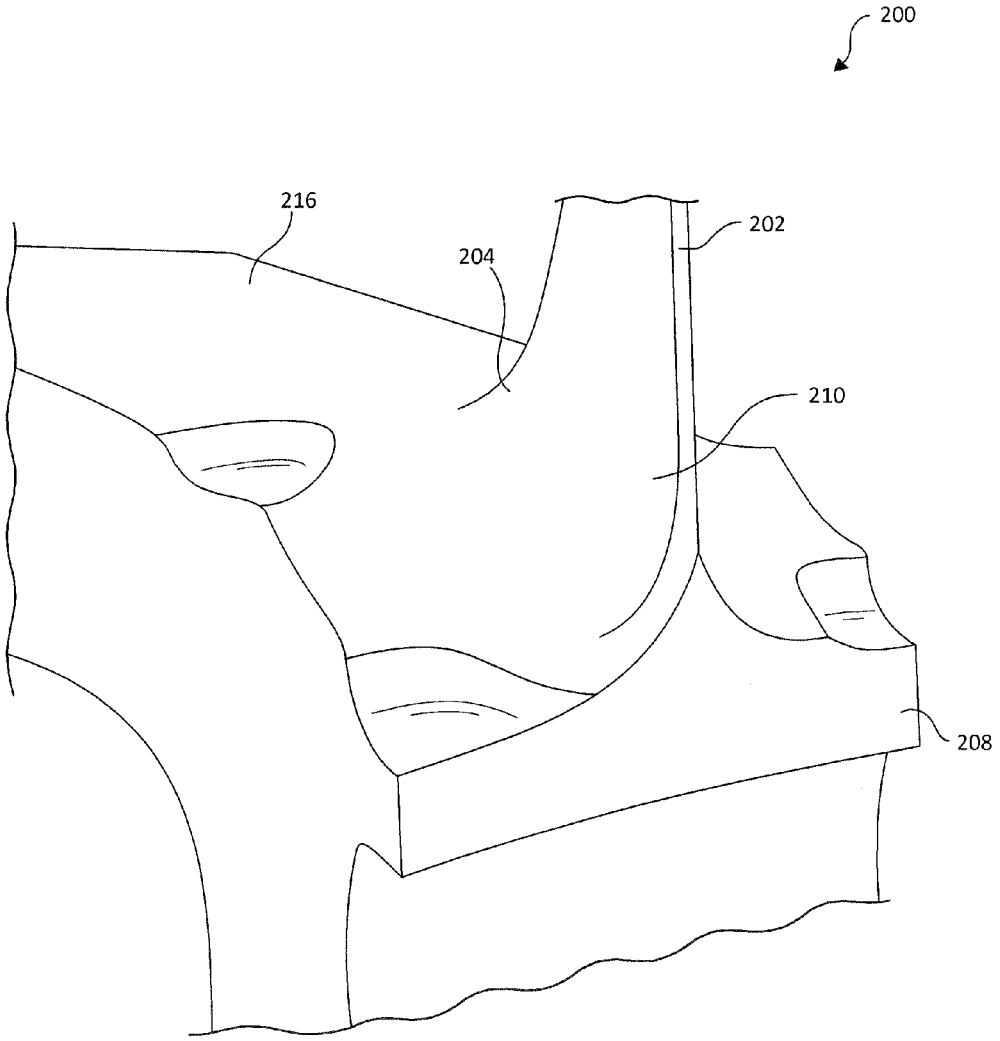

With reference to FIGS. 2A and 2B, there is an airfoil 200 in accordance with illustrated embodiments. Airfoil 200 may comprise, for example, an airfoil body 202. Airfoil body 202 comprises a first end 204 and a second end 206. Airfoil body 202 may extend radially from a center line of gas turbine engine 20 such that second end 206 is at a further radial distance from the center line than first end 204. The distance between first end 204 and second end 206 may, for example, comprise an airfoil body span length 220. Stated another way, airfoil body span length 220 is the length of airfoil body 202 in the radial direction.

First end 204 of airfoil 200 is coupled to a platform 208. For example, airfoil 200 may be coupled and secured to platform 208 by welding, machining, press fitting, and any other acceptable method of coupling.

Airfoil 200 may further comprise, for example, a fillet 210. Fillet 210 extends from a surface 216 of platform 208 to first end 204. For example, fillet 210 may comprise a conic surface that curves in the radial direction up from surface 216 to contact and join to first end 204.

The height of the fillet 210 in the engine radial direction is defined as the distance between surface 216 of platform 208 and the point at which fillet 210 contacts airfoil body 202 in the radial direction. Fillet height may be greater than approximately 15% of airfoil body span length 220, or greater than approximately 20% of airfoil body span length 220, and further equal to approximately 21% of airfoil body span length 220. Alternatively, fillet height may be greater than 21% of airfoil body span length 220.

Airfoil 200 may be positioned within compressor section 24 of gas turbine engine 20. For example, airfoil 200 may be positioned within the high pressure portion of compressor section 24. Alternatively, airfoil 200 may be positioned within turbine section 28 of gas turbine engine, such as, for example, the high pressure portion of turbine section 28.

Figure 2C:
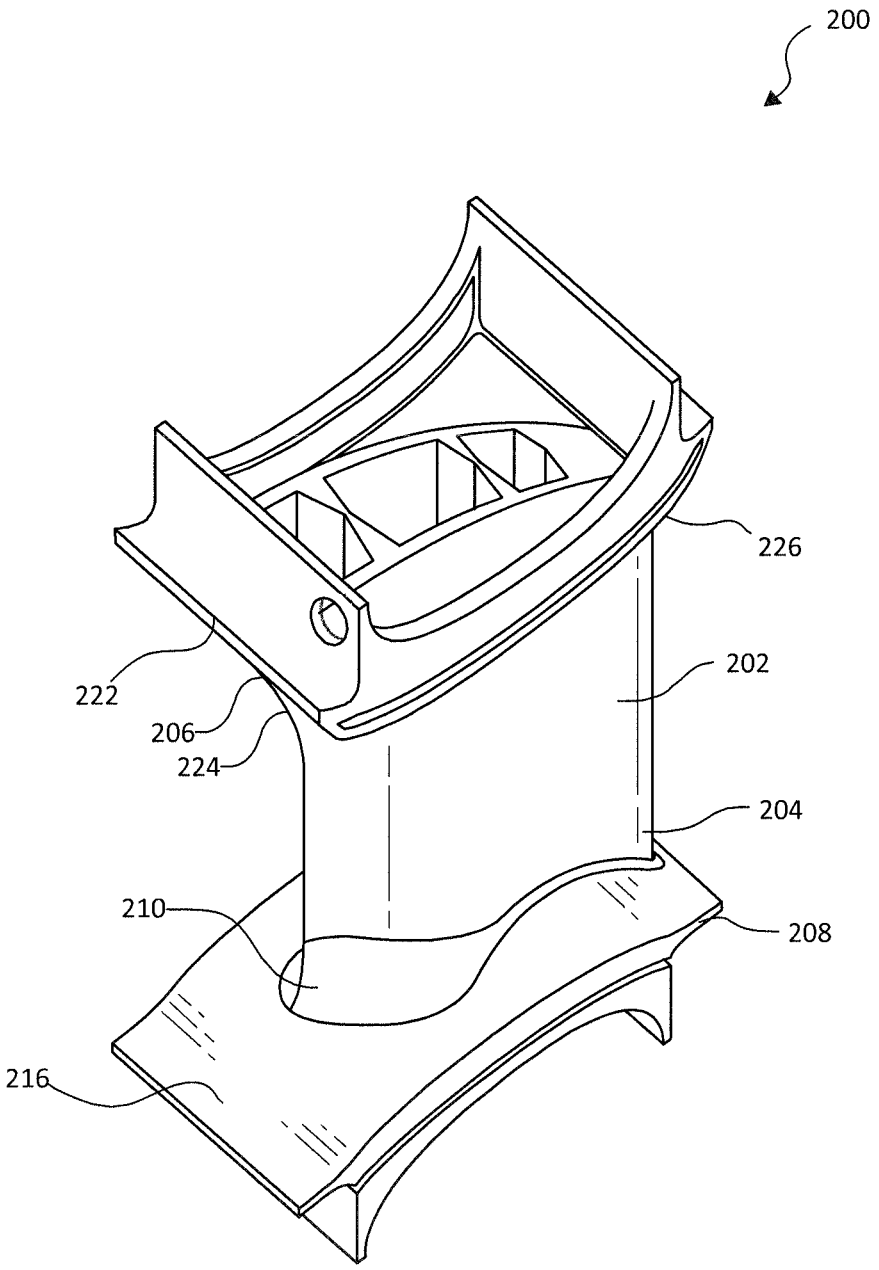

Airfoil 200 illustrated in FIG. 2B comprises a blade such as, for example, blade 25, and second end 206 of airfoil body 202 comprises a tip. As illustrated in FIG. 2C, airfoil 200 comprises a vane coupled to a second platform 222. Further, a second fillet 224 may extend from a surface 226 of second platform 222 to second end 206. Similar to fillet 210, second fillet 224 may comprise a conic surface that curves in a radial direction up from surface 226 to contact and join to second end 206.

Airfoil body 202, platform 208, fillet 210, and, where airfoil 200 is a vane, second platform 222 and/or second fillet 224 may all be made of nickel. Although described with reference to a particular metal material (i.e., nickel), airfoil 200 and its various components may comprise any suitable metallic (such as titanium) or non-metallic material.

Fillets in accordance with the present disclosure may, for example, experience reduced stresses during acceleration and/or deceleration of gas turbine engine 20. Further, fillets of the present disclosure cause minimal interference with the aerodynamics of gas path air flowing across airfoil 200.

Benefits, other advantages, and solutions to problems have been described herein with regard to specific embodiments. The scope of the disclosure, however, is provided in the appended claims.

What is claimed is:

1. An airfoil, comprising;

an airfoil body having a first end coupled to a platform and a second end radially extending from the platform; and a fillet joining the first end of the airfoil body to a surface of the platform, and comprising a fillet height of at least 20% of an airfoil body span length over at least one of a pressure side or a suction side, the fillet extending to a trailing edge of the airfoil body and a trailing edge of the platform.

2. The airfoil of claim 1, wherein the fillet height is approximately 21% of the airfoil body span length.

3. The airfoil of claim 1, wherein the airfoil is positioned within a compressor section of a gas turbine engine.

4. The airfoil of claim 3, wherein the airfoil is a high pressure compressor airfoil.

5. The airfoil of claim 1, wherein the airfoil is a blade.

6. The airfoil of claim 1, wherein the airfoil body comprises nickel.

7. The airfoil of claim 1, wherein the airfoil comprises a vane, and wherein the second end of the airfoil body is coupled to a second platform.

8. The airfoil of claim 7, further comprising a second fillet having a second fillet height of at least 20% of the airfoil body span length.

9. A gas turbine engine, comprising;

An engine section comprising one of a turbine section and a compressor section; and an airfoil positioned within the engine section comprising an airfoil body having a first end coupled to a platform and a second end radially extending from the platform; and a fillet joining the first end of the airfoil body to a surface of the platform, and comprising a fillet height of at least 20% of an airfoil body span length over at least one of a pressure side or a suction side, the fillet extending to a trailing edge of the airfoil body and a trailing edge of the platform.

10. The gas turbine engine of claim 9, wherein the fillet height is approximately 21% of the airfoil body span length.

11. The gas turbine engine of claim 9, wherein the airfoil is a high pressure compressor airfoil.

12. The gas turbine engine of claim 9, wherein the airfoil is a blade.

13. The gas turbine engine of claim 9, wherein the airfoil body comprises nickel.

14. The gas turbine engine of claim 9, wherein the airfoil comprises a vane, and wherein the second end of the airfoil body is coupled to a second platform.

15. The gas turbine engine of claim 14, further comprising a second fillet having a second fillet height of at least 20% of the airfoil body span length.

16. A gas turbine engine section, comprising;

an airfoil positioned within the gas turbine engine section, comprising a body having a first end coupled to a platform and a second end radially extending from the platform; and a fillet joining the first end of the airfoil body to a surface of the platform, and comprising a fillet height of at least 20% of an airfoil body span length over at least one of a pressure side or a suction side, the fillet extending to a trailing edge of the airfoil body and a trailing edge of the platform.

17. The gas turbine engine section of claim 16, wherein the gas turbine engine section comprises one of a turbine section and a compressor section.

18. The gas turbine engine section of claim 17, wherein the airfoil is a high pressure compressor blade.

19. The gas turbine engine section of claim 16, wherein the airfoil comprises a vane, and wherein the second end of the airfoil body is coupled to a second platform.

20. The gas turbine engine section of claim 19, further comprising a second fillet having a second fillet height of at least 20% of the airfoil body span length.

* * * * *